US006246712B1

(12) United States Patent
Whyte et al.

(10) Patent No.: US 6,246,712 B1
(45) Date of Patent: Jun. 12, 2001

(54) ARC FURNACE PROTECTION

(76) Inventors: Rodney Murison Whyte, 136 Cecily Road, Valeriedene, 2195; Edwin Harm Roos, 44 3rd Road, Kew, Johannesburg, 2090; Andrew Bryan Johnston, 1 Montana, Wood Road, Blackheath, Johannesburg, 7580, all of (ZA); Jan Abraham Ferreira, Wethouder Verheulplantsoen 6, 2289 KE Rijswijk (NL); Dirk Renaat Gabriel Faveere; Anthony Wayne Wewege, both of 30 Raven Street, Saldanha (ZA)

( * ) Notice: Subject to any disclaimer, the term of this patent is extended or adjusted under 35 U.S.C. 154(b) by 0 days.

(21) Appl. No.: 08/987,046

(22) Filed: Dec. 10, 1997

(30) Foreign Application Priority Data

Dec. 10, 1996 (ZA) ..... 96/6696

(51) Int. Cl.[7] ..... F27D 1/00

(52) U.S. Cl. ..... 373/71; 373/74; 164/459

(58) Field of Search ..... 373/71, 73, 74, 373/70, 104, 105, 60, 18, 8–9, 72, 75–76, 78–83; 75/10.21, 10.19, 10.36; 110/335; 164/459, 513

(56) References Cited

U.S. PATENT DOCUMENTS 895,051 * 8/1908 Sleicher ..... 110/335
3,385,920 * 5/1968 Harbaugh et al. ..... 373/70
3,448,703 * 6/1969 Hansen et al. ..... 110/335
3,730,961 * 5/1973 Bryce ..... 373/60
3,898,366 8/1975 Aurini .
3,929,456 * 12/1975 Kibby ..... 75/10.21
3,937,869 * 2/1976 Markarian et al. ..... 373/105
4,063,028 * 12/1977 Longenecker ..... 373/74
4,152,534 * 5/1979 Iwashita ..... 373/73
4,202,400 * 5/1980 Gigliotti, Jr. et al. ..... 164/513
4,238,632 12/1980 Yasukawa et al. .
4,273,949 * 6/1981 Fischer et al. ..... 373/74
4,453,253 6/1984 Lauria et al. .
4,618,963 10/1986 Rappinger et al. .
4,677,643 * 6/1987 Dicks ..... 373/105
4,797,897 * 1/1989 Stenzel et al. ..... 373/105
4,881,239 * 11/1989 Stenzel et al. ..... 373/70
5,009,703 * 4/1991 Arvidson et al. ..... 75/10.36
5,132,984 * 7/1992 Simpson ..... 373/18
5,368,627 * 11/1994 Cowx ..... 75/10.19
5,651,411 * 7/1997 Hirano et al. ..... 164/459

OTHER PUBLICATIONS

International Search Report in WO 98/26245.

* cited by examiner

*Primary Examiner*—Teresa Walberg
*Assistant Examiner*—Quang Van
(74) *Attorney, Agent, or Firm*—Jones, Tullar & Cooper, P.C.

(57) ABSTRACT

An arc furnace which includes a shell with a hearth, a roof for the shell, the roof including a plurality of segments which are substantially electrically isolated from each other and from the shell, an electrode and a refractory section on the roof, and wherein the refractory section is at least partly electrically conductive.

10 Claims, 6 Drawing Sheets

ARC FURNACE PROTECTION

BACKGROUND OF THE INVENTION

The present invention relates generally to an arc furnace and more particularly to electrical instabilities which arise in an arc furnace during its operation.

The torn "stray arcing" has been used to describe this type of instability for some evidence seems to indicate that stray arcing may take place inside the furnace e.g. between the electrode and the furnace roof, or between other surfaces inside the furnace.

The present invention has application to DC and AC electric arc furnaces.

During the operation of a DC-arc furnace slag is displaced by the action of the arc from the molten slag layer onto the side walls and roof of the furnace. Hot dust particles and condensing vapours also adhere to the side walls and the roof. The slags are generally non-conductive, or poor conductors, in a cold state.

At elevated temperatures the insulating properties of slag, and in particular of slags which contain high percentages of certain oxides such as titanium dioxide, deteriorate. The resistivity of these slags can drop to such an extent that the material becomes electrically conductive. Consequently, inside the furnace, a conducting layer exists on the roof and side walls thereby imparting to the roof and side walls the same electrical potential as the top of the molten bath inside the furnace. The conducting layer thus promotes arcing for it provides a current path between cathode and anode.

The conditions inside the furnace, which give rise to stray arcing, are variable. For example the main arc is not perfectly stable, frothing and sparking take place, the slag is produced over a period of time, the level of the molten bath changes, and fluctuations exist in the rate, and the composition, of material feed to the furnace. Consequently measures which are taken to control stray arcing should, preferably, be adaptable in response to changes inside the furnace whether of the aforementioned kind or due to other factors such as temperature and pressure fluctuations, and in response to variations in the power supply to the furnace i.e. in the voltage applied to, and the current drawn by, the furnace.

The arcing can damage components of the roof, shell and hearth of the furnace and can lead to substantial reductions in furnace productivity. In water cooled furnaces the rupturing of water conduits by arcing can lead to water entering the furnace which can result in a powerful and damaging explosion.

The invention is concerned with improving the economic performance of an electric arc furnace by reducing the likelihood of arc damage to the furnace.

SUMMARY OF THE INVENTION

The present invention provides an arc furnace which includes a shell with a hearth, a roof for the shell, the roof including a plurality of segments which are substantially electrically isolated from each other and from the shell, an electrode, and a refractory section on the roof, wherein the refractory section is at least partly electrically conductive.

The refractory section may be made from or include refractory material which, itself, may be electrically conductive. Alternatively or additionally at least one electrically conductive member, which may be of any suitable shape and size, is located at least partly in the refractory section.

In one form of the present invention the electrically conductive member is exposed to the interior of the furnace.

In a different form of the present invention the electrically conductive member is not exposed to the interior of the furnace i.e. it is shielded by the refractory section.

In the last-mentioned embodiment a direct conductive connection between the furnace interior and the electrically conductive member can thus take place only when the refractory section has been eroded to expose, at least partly, the electrically conductive member.

A plurality of the electrically conductive members may be used, located to different extents, according to requirement, in zones of the refractory section. The exposure of an electrically conductive member, due to erosion of the refractory section material, may therefore provide a means of assessing the deterioration or wear of the refractory section and consequently of indicating when damage to sensitive components, such as water cooling circuits in the refractory section, is likely to occur. This approach may make it possible to develop a diagnostic system which gives an early warning of the degradation of the mechanical deterioration of the system.

The electrically conductive member may be of any suitable electrically conductive material and preferably is copper.

The electrically conductive member may be made in any suitable shape or size and may be pin-shaped, in the nature of a circular cylinder. A suitable length is of the order of 550 mm with a diameter of approximately 120 mm. Those dimensions are given only by way of example, and are non-limiting, for other dimensions which take electrical and thermal conductivity into account will also function satisfactorily.

A plurality of electrically conductive members may be used. Those members may be arranged around the electrode in any suitable pattern, for example at spaced intervals on the circumference of one or more circles which are centered on the electrode.

The electrically conductive members are positioned so that they do not contact the electrode nor the roof and are electrically isolated from the electrode and roof.

At least some of the members may be wholly embedded in at least some of the roof segments.

Alternatively or additionally at least some of the members may be positioned so that they are partly embedded in at least some of the roof segments and are partly exposed to the slag which is formed during the operation of the furnace and which adheres to the roof segments.

The electrically conductive members may be electrically connected to each other, or to one or more controlled electrical potentials, in any appropriate and desired way or configuration.

The roof may be water cooled and may be formed from a number of water cooled roof segments or panels, although the present invention affords protection to other roof types e.g. of the type which includes spray cooled roof segments or panels.

The electrically conductive members may be cooled using any suitable fluid e.g. water or an air/water mixture and a fluid cooling circuit to the electrically conductive members may be positioned away from the refractory section so that, if the refractory section is damaged by arcing, the likelihood of damage to the cooling circuit of the electrically conductive members is reduced. The cooling fluid or technique should be such that the amount of water which enters the furnace, when the cooling circuit is damaged, is minimized.

Depending on the furnace type the voltage gradient may be established using a fixed AC or DC voltage, and hence may be a static or steady state gradient generated, for example, by means of a resistive network.

The gradient may alternatively be variable or dynamic and may be established by switching devices which are responsive to operating conditions in the furnace. Again, depending on the furnace type, the switching devices operate on AC or DC voltages.

The voltage difference, e.g. between the refractory section and an adjacent component of the furnace, established by the voltage gradient may be between 5% and 50% of a supply voltage which is applied to the furnace. In one example the voltage difference is of the order from 50 volts to 80 volts.

The connection of the electrically conductive members to earth or any other controlled electrical potential enables any current attracted to the electrically conductive members during arcing to be directed to earth or any other controlled electrical potential. By varying the controlled electrical potential, on the other hand, conditions which give rise to arcing may be controlled and the incidence of arcing may be limited.

The electrically conductive members may be connected to earth or any other controlled electrical potential using any appropriate device or devices. It is also possible to connect different segments or panels to suitable controlled electrical potentials, using any appropriate devices, to control stray arcing to such segments or panels.

Such connection devices may take on any suitable form. In one form of the present invention use is made of resistive potential dividers to impress desired voltage levels on or across different roof segments or parts or sections of the furnace.

Use may however be made of active mechanisms to provide the controlled electrical potentials in response to the prevailing relevant conditions in the furnace, in order to limit stray arcing or to extinguish an arc. For example use may be made of converters using semiconductor devices in the switched mode or linear controlled mode which are able in principle to deliver an electrical supply to the load, and to dissipate power absorbed from the load.

The power rating of the power source providing the controlled electrical potential may be limited and may be less than 5%, and is preferably not more than 1%, of the rating of the power supply of the furnace. These values are of an illustrative nature only and are not limiting.

Without being restrictive suitable semiconductor devices are thyristors in controlled rectifiers, bipolar transistors, insulated gets bipolar transistors, and gate turn-off thyristors in DC to DC or AC to DC convertors. Such devices may operate directly on single or multiphase alternating power supplies, from an uncontrolled rectified power supply, or directly from the DC supply to the furnace in order to provide suitable voltages which are applied as required to the roof segments.

Such devices may include protection mechanisms of any suitable form in order to limit the power diverted from, or injected into, the arc furnace. Without being restrictive use may for example be made of current limiting means e.g. blocking diodes and fuses, for the aforementioned purpose.

The controlled electric potentials may be regulated, preferably dynamically, to limit the degree of stray arcing to the electrically conductive member or members, while at the same time preventing stray arcing from damaging the furnace. The controlled electrical potential or potentials are also limited to prevent the electrically conductive member or members from becoming sources of stray arcing.

The current flow to earth or any other controlled electrical potential may be monitored in order to obtain a measure of the degree of arcing to the furnace roof. It also falls within the scope of the present invention to monitor the amplitude of the current to earth or any other controlled electrical potential and, when this current exceeds a predetermined limit, to interrupt or reduce the electrical supply to the furnace power source or to initiate any other suitable action in order to limit potential damage to the furnace which is due to arcing.

The present invention also provides a method of controlling stray arcing in an arc furnace which includes a shell with a hearth, a roof for the shell and electrode and a refractory section on the roof, the method including the step of establishing a voltage gradient at least between the refractory section and at least one component of the furnace.

The voltage gradient may be established between the refractory section and the electrode, between the refractory section and a seal between the electrode and the refractory section, or between the refractory section and a component of the shell.

The voltage gradient may be substantially fixed and predetermined. Alternatively the voltage gradient may vary dynamically in response to operating conditions in the furnace.

BRIEF DESCRIPTION OF THE DRAWINGS

The present invention is further described by way of examples with reference to the accompanying drawings in which.

DESCRIPTION OF PREFERRED EMBODIMENTS

Figure 1:
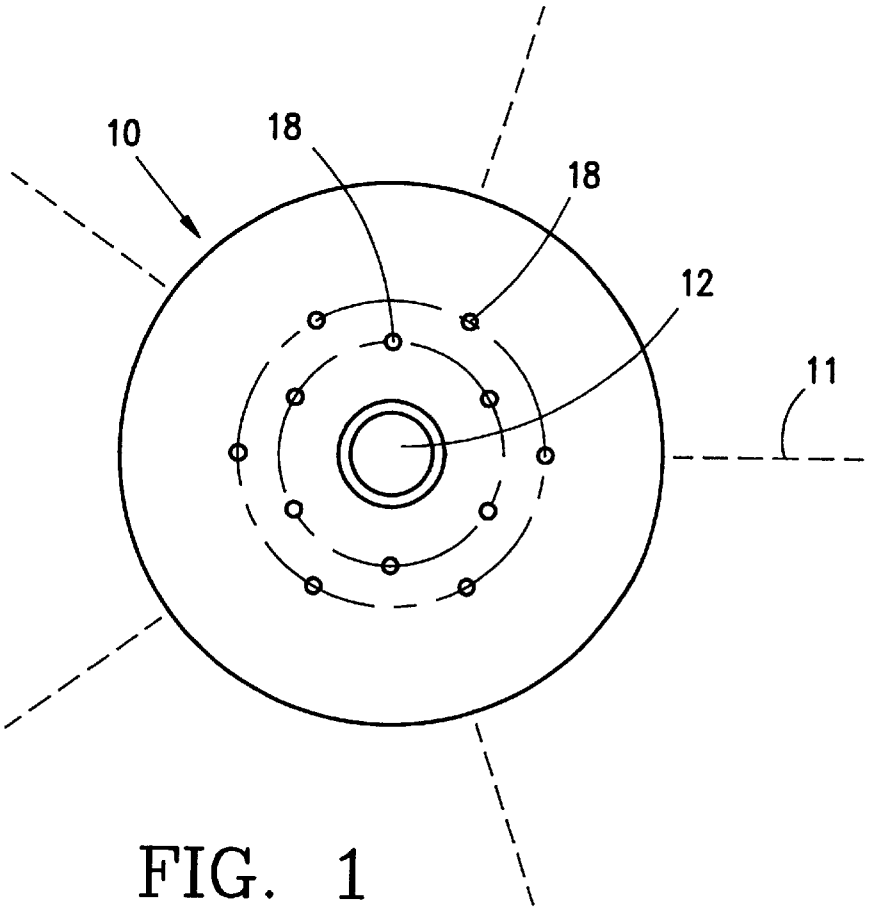
FIG. 1 is a plan view of a central zone of a central roof of a DC-arc furnace according to the present invention.

FIG. 1 of the accompanying drawings illustrates a central zone of a central roof 10 of a DC-arc furnace according to the present invention which is formed or covered in a known manner from refractory material and which is cooled by circulating water through conduits in the material, or by spraying water onto the material. The central roof is surrounded by roof panels or segments, shown by dotted lines 11.

Figure 2:
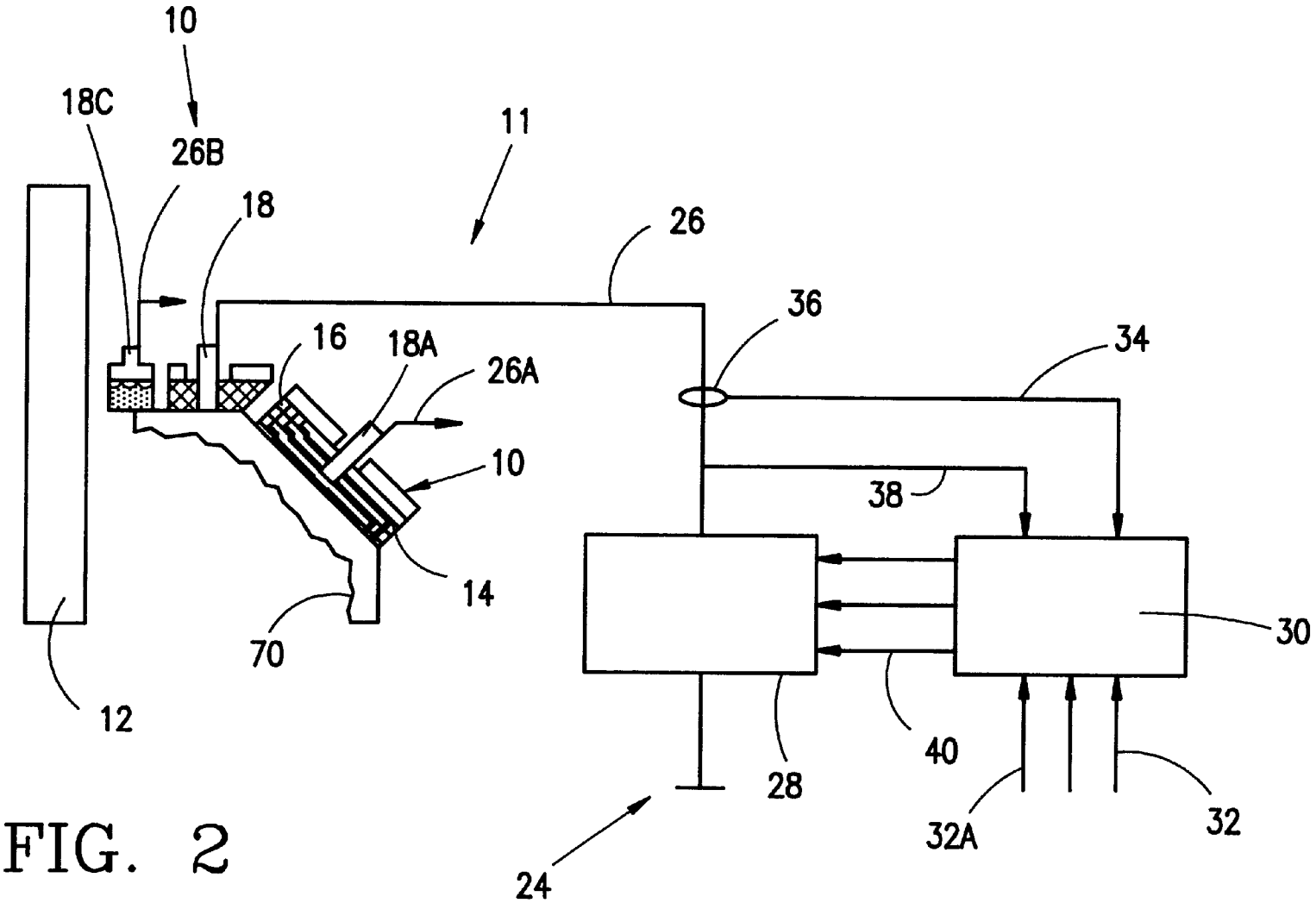
FIG. 2 is a cross sectional view through portion of a furnace, schematically illustrating an arrangement according to the present invention.

FIG. 2 is a cross-sectional view through the roof of the furnace. An electrode 12 extends through the central zone 10 which caps a shell which extends from a hearth of the furnace. In use the hearth constitutes the anode of a DC supply, not shown, and the electrode 12 constitutes the cathode. At least the central zone of the roof 10 is formed or covered with a refractory material 14 and water carrying conduits 16, embedded in the refractory material, are used for cooling purposes. The physical structure of the furnace, which is substantially conventional, is shown in further detail in FIGS. 7 and 8.

A number of water cooled electrically conductive a members 18, in this case copper pins, are arranged at spaced intervals on the circumference of two circles which are centered on the electrode 12. The members 18 are mounted in the refractory material and do not make direct contact with the electrode 12 nor with the water cooled roof, but are in contact with the slag.

Figure 4:
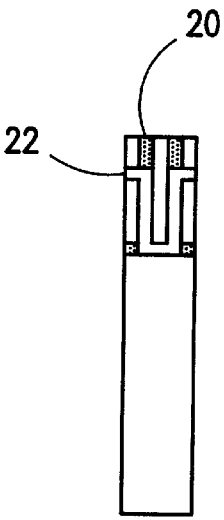
FIGS. 3 and 4 are side views, displaced at 90° to one another, of an electrically conductive member, or pin, used in the furnace of the present invention.
Figure 3:
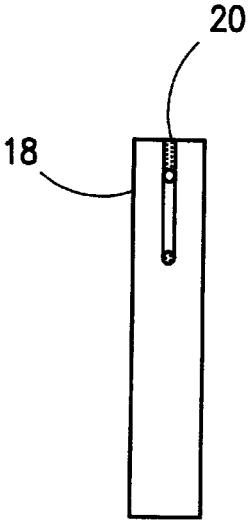

FIGS. 3 and 4 illustrate the construction of a typical electrically conductive member 18. Each electrically conductive member is of the order of 550 mm long and has a diameter of the order of 120 mm. The electrically conductive members are bored transversely and in the axial direction, as shown in FIG. 4, and sections 20 of the bores, which are shaded in FIGS. 3 and 4, are plugged thereby to form a U-shaped cooling duct 22 which is connected in a circuit, through which is circulated water or an air/water mixture, for cooling purposes.

It is to be noted from FIGS. 3 and 4 that the water cooling is carried out at the upper and of each electrically conductive member.

Figure 6B:
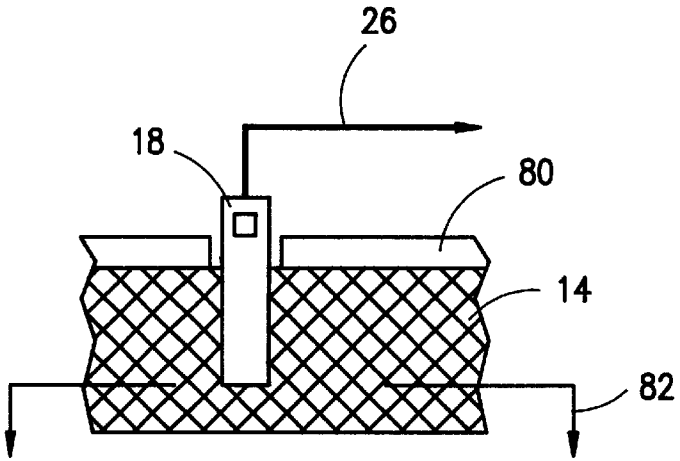
FIGS. 6A, 6B and 6C respectively show different configurations of a conductive member used in the furnace of the present invention.
Figure 6A:
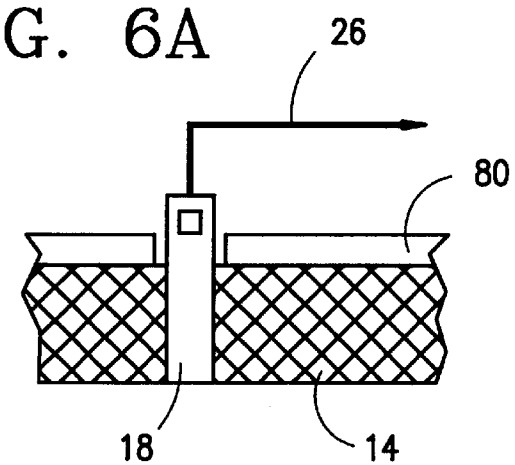

The water cooled electrically conductive members are designed and installed in the furnace in such a way that the cooling ducts 22 are situated at least partly outside the refractory material 14, see FIGS. 2, 6A and 6B. Consequently if the electrically conductive members are damaged by arcing within the furnace the likelihood that water will escape from the water circuit and enter the furnace is reduced.

FIG. 2 schematically shows that the electrically conductive members 18 are connected to any suitable controlled electrical potential 24, which could be ground, via a conductor 26 and a power unit 28. The power unit may take on any of the configurations shown in FIGS. 5A to 5D.

FIG. 5 illustrates four configurations of the power unit designated 28A to 28B which respectively include a current limiting switch, a resistive divider, a linear power supply and a switch mode power supply.

The unit 28, see FIG. 2, is connected to a controller 30 and process parameters 32 may be used to regulate the operation of the controller. The controller is responsive to a current measurement 34 obtained from a current probe 36, and a voltage measurement 38.

Depending on the nature of the power unit and the controller, control signals 40, produced by the controller in response to the input parameters, may be used to control the operation of the unit 28.

The control unit 30 may take on any suitable form and may include dedicated analog signal circuits or a microcontroller to generate the signals 40. The controller could also be based on the use of a programmable logic controller (PLC) which is used for controlling the operation of the furnace and which is responsive to information about the operation of the furnace. Based on this an adaptable control, which is responsive to furnace power levels and changes of physical conditions inside the furnace, can be implemented.

In FIG. 2 only one of the conductive pins 18 is connected to the power unit. Additional connections 26A could be made to further pins 18A. Depending on the nature of the roof, an aspect which is described further herein with reference to FIG. 6, additional connections 26B could be made to conductive components 18C of the roof.

Figure 5A:
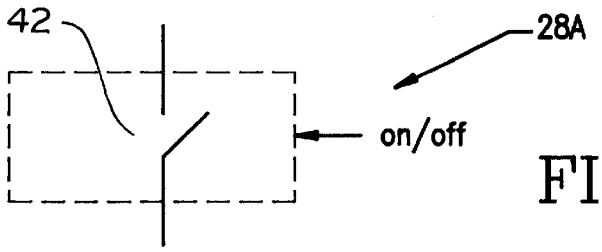
FIGS. 5A, 5B, 5C and 5D respectively illustrate different power units for use in the arrangement of FIG. 2.

The power unit 28, in the form shown in FIG. 5A, includes a simple interrupting switch 42. If uncontrolled arcing occurs in the furnace then the ground conductor 26 carries any current which is attracted to the electrically conductive members 18 and which is caused by the arcing, to ground, thereby affording protection to the furnace roof. The ground current is monitored by the current probe 36 and a measurement of the degree of arcing which is taking place can therefore be obtained. It is also possible to compare the current flowing through the conductor 26 with a reference value 32A and, if the reference value is exceeded, to operate the switch and so interrupt the supply of current to the furnace. Thus if the secondary arcing is of such an extent that damage to a furnace component is likely to occur then the supply of current to the furnace can be immediately interrupted to limit the potential damage.

A similar technique can be adopted to limit damage which may arise due to other occurrences, for example when the refractory material 14 is eroded to an unacceptable level or when the water cooling circuit 16 is exposed or in danger of being exposed. The power supply which is required to measure conductivity is relatively small compared to the power requirement of a system which is used to control voltages at locations in the furnace, as is described hereinafter.

Figure 5B:
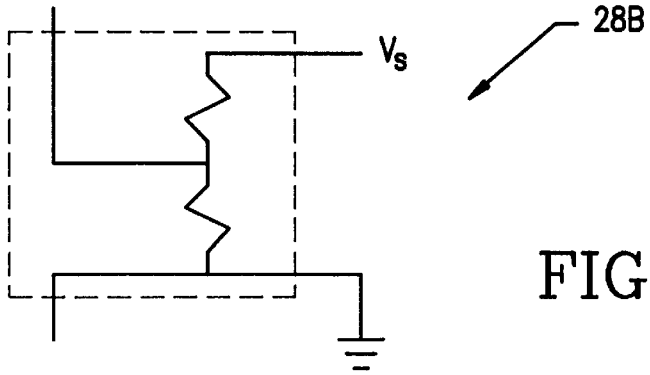
Figure 5C:
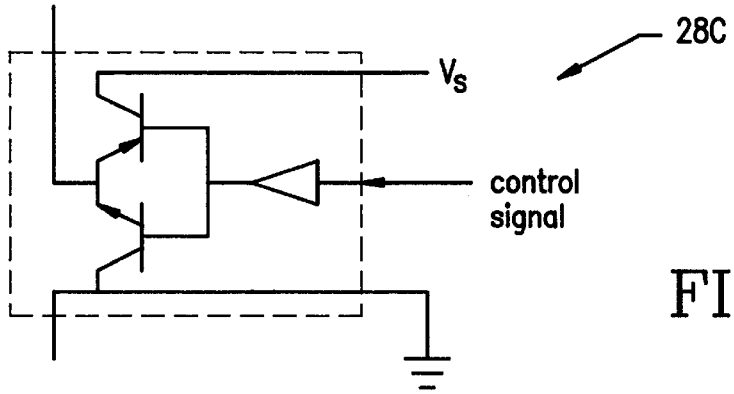
Figure 5D:
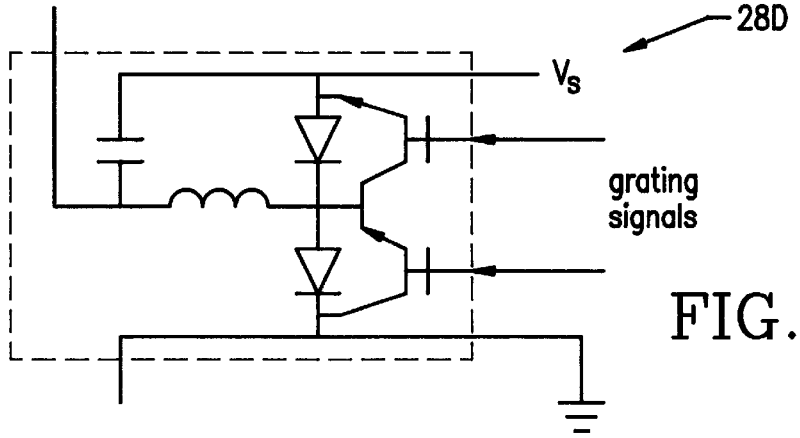
Figure 7:
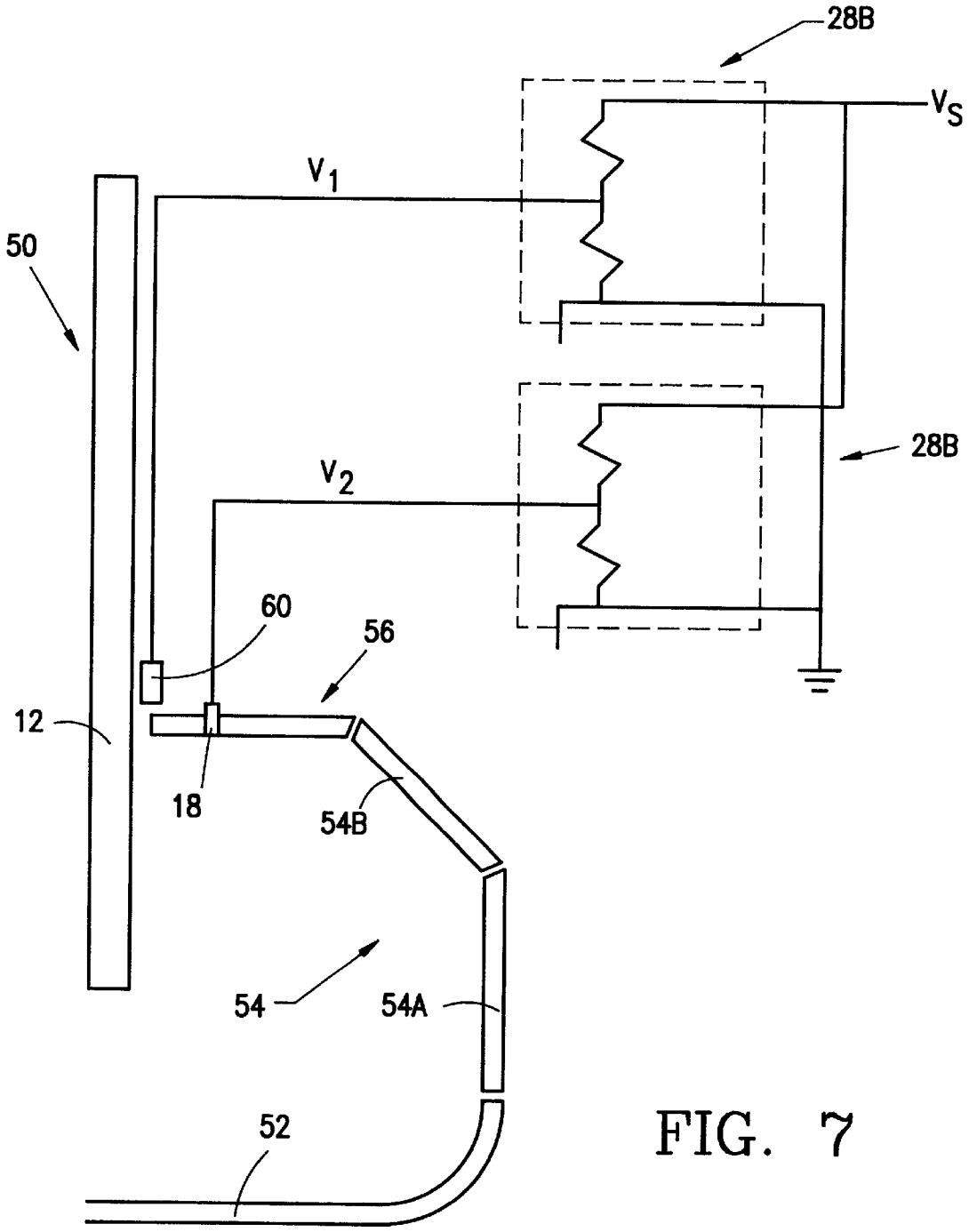
FIG. 7 in a cross sectional view of a furnace installation, according to the present invention, which makes use of a resistive voltage divider.

FIG. 5B illustrates that the power unit 28, in this case designated 28B, may also comprise a resistive voltage divider and FIG. 7 shows, in cross section, a portion of a DC arc furnace installation 50 which makes use of such a divider network. The drawing illustrates a hearth 52 of a furnace and a shell 54 which includes circumferential sections 54A and 54B respectively.

A roof is partly formed for the shell by means of a center ring 56, which is made from refractory material, and an electrode 12 extends through a central opening in the ring. The remainder of the roof is made from a number of segments or roof panels which are electrically isolated from each other, and from the ring. An electrode seal 60 surrounds the electrode 12 and is located to seal the gap between the electrode and the ring 56. One or more of the electrically conductive members or pins 18 are mounted in the ring.

Resistive voltage divider networks 28B are connected to a voltage source $V_S$ and provide voltages $V_1$ and $V_2$ connected respectively to the seal 60 and the conductive pins 18. The voltage $V_S$ could either be the voltage which is applied to the electrode 12 or could be sourced externally. The voltage dividers provide passive current limiting.

The values of the resistors are chosen so that the respective voltages $V_1$ and $V_2$ produce voltage gradients between each successive pair of components of the furnace which are sufficiently low to ensure that the likelihood of arcing taking place between the components is reduced. A suitable voltage difference is from 0% to 50% of the furnace supply voltage and, in one example, the voltage difference is from 50 volts to 80 volts.

The arrangement shown in FIG. 7 has the attraction that it is relatively easy to implement. It does however suffer from the disadvantage that the voltage differences are chosen beforehand according to a given set of conditions inside the furnace. As the conditions inside the furnace are not static it follows that the voltage differences will not be at optimum levels for all operating conditions.

A similar divider network 28B, not shown, could be connected to the section 54B if the voltage of this section proves to be controllable.

As has been stated the resistive divider 28B of FIG. 5B provides passive current limiting. The power units 28C and 28D are respectively based on the use of a linear power supply and a switch mode power supply and provide active current limiting. In these cases the current limiting is effected by means of a current control loop. The current needs to be limited in order to protect the power unit integrity and to prevent the power unit, itself, from becoming a source of arcing.

Figure 8:
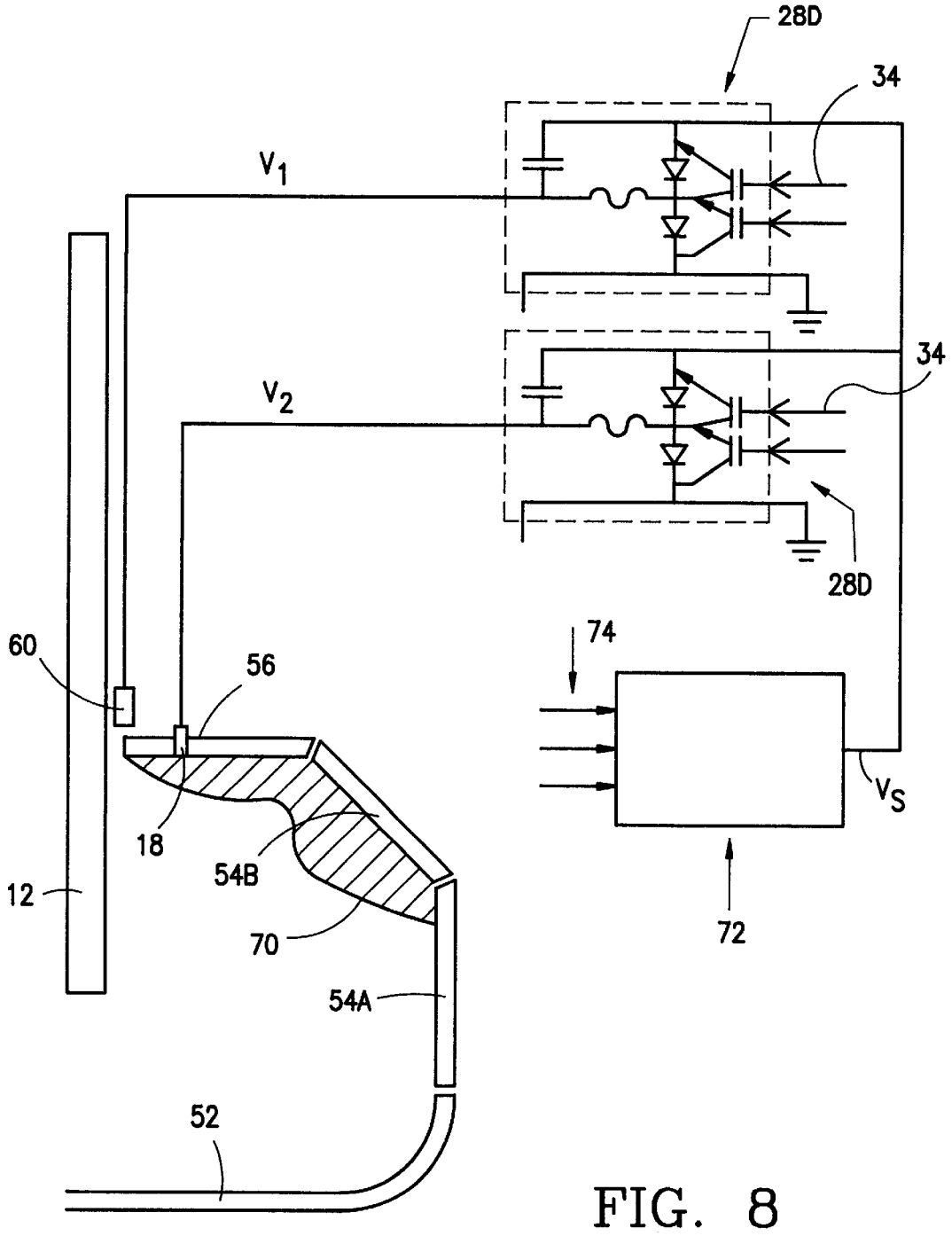
FIG. 8 is a cross sectional view of a furnace installation, according to a variation of the invention, which makes use of dynamic control techniques.

FIG. 8 illustrates the use of two power units 28D which respectively provide voltages $V_1$ and V2 applied to the seal 60 and the conductive pins 18. The power units make use of insulated gate bipolar transistors (IGBT) to switch a supply voltage $V_S$ in a controlled manner, in response to the process parameter signals 34.

The voltage $V_S$ could be the voltage which is present on the electrode 12. Alternatively the voltage is produced by a rectifier unit 72, of any appropriate kind, to which a three phase supply 74 is applied.

The units 28D include LC filters and are suited for supplying high power levels. They are used for actively controlling the voltages $V_1$ and $V_2$ in accordance with a program held the controller 30 which, in turn, is subject to at least the following process parameters 32: the furnace controller tap setting and the operating point of a furnace rectifier. This approach permits the voltage gradients, i.e. the voltage differences between successive pairs of furnace components, to be maintained in a dynamic or adaptive fashion throughout the operating range of the furnace rectifier.

Clearly modifications would be required for AC furnaces which do not have rectifiers.

For a furnace under test it was found that the optimum voltage between the components 58 and 60, and the components 60 and 56, lay between 50 volts and 80 volts.

The units 28D permit the furnace rectifier voltage to be clamped at a safe predetermined value, of the order of 150 volts, whenever the arc is lost in the furnace. This prevents arcing to the panels of the roof 56 prior to striking an arc or when an arc is lost.

The temperature of the slag 70 (see FIGS. 2 and 8) which is in contact with the conducting pin or pins 18, affects the resistivity of the slag, and hence determines the voltage $V_2$ to a substantial extent. A voltage in excess of the furnace voltage may be required in extreme cases in order to overcome the slag resistance. It has been found for a particular installation that stray arcing only occurs when the power which is drawn by the furnace is in excess of a threshold value which, in the example under test, was of the order of 20 megawatts. Thus the voltage grading circuit was only required when the furnace operated above the threshold value.

The grading of voltages may be used to aid in the formation of thermal banks inside the furnace. The thermal banks provide a degree of thermal insulation for the upper reaches of the shell and the roof. The power units 28D are used to establish voltage differences so that particles from the electrode which are charged to the electrode potential are attracted to the furnace roof and to the inner upper reaches of the shell, which are held more positive by the power units. In this way the thermal banks can be built up in a manner which, substantially, lends itself to control. Conversely an inappropriate grading of the voltage differences may negatively impact on the formation of the thermal banks on the inner surfaces of the furnace.

The power unit 28 can be used to achieve at least the following objectives:

(a) a reduction in stray arcing;

(b) to clamp the upper sections of the furnace to ground in the event of an emergency;

(c) to assist in building up thermal banks inside the furnace.

It is apparent that one or more units 28C can be used in place of the units 28D to provide the desired voltages $V_1$ and $V_2$.

In FIGS. 7 and 8 the electrically conductive pins 18 are directly connected to the units which establish the voltage gradients. The refractory material itself may be electrically conductive and, in this instance, additional connections may be made to the material.

Figure 6C:
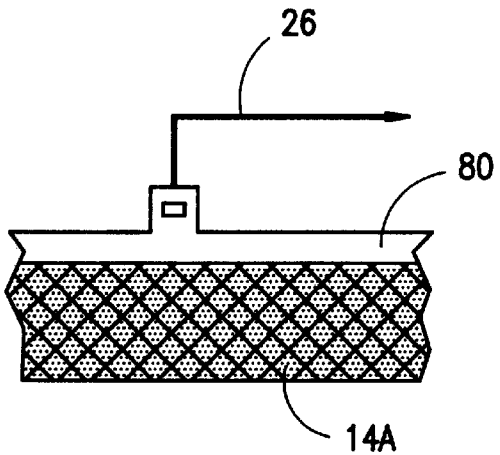

FIGS. 6A, 6B and 6C illustrate different conductive member configurations. In FIG. 6A a pin 18 is exposed to the interior of the furnace. Care must however be taken to avoid arcing taking place directly to the exposed surface of the pin. It can be seen that the pin is embedded in the refractory material 14 but is spaced from and does not contact an upper steel frame 80.

FIG. 6B illustrates a variation wherein the pins are not exposed to the interior of the furnace and are shielded from the furnace interior by means of a layer of the refractory material. With this arrangement a direct conductive connection between the furnace interior and the pins can only take place when the refractory material has been eroded to an extent 82 to expose, at least partly, the electrically conductive pins. This event can readily be detected when it occurs by detecting the resulting increase in current flow from the pins, and a measure of the erosion which has taken place can thus be obtained.

The pins may be located to different extents, according to requirements, in the refractory material of the roof panels. The exposure of an electrically conductive pin, due to erosion of the refractory material, may therefore provide a means of assessing the deterioration or wear of the refractory material and of indicating when damage to sensitive components such as water cooling circuits in the refractory material is likely to occur. Thus, as the pins are exposed, there is a decrease in resistance between the pins and the cathode, or anode, and this can readily be detected.

Another possible arrangement is shown in FIG. 6C. In this instance the refractory material, designated 14A is, itself, conductive. The refractory material is in contact with a supporting steel frame 80 and the electrical lead 26 is directly connected to the steel frame. This arrangement, which has been referred to hereinbefore, permits the pins 18 to be dispensed with and the respective voltage gradient is, instead, established by making electrical connections directly to the conductive roof.

It is to be understood that the conductive members i.e. the pins could be located at desired positions in the roof ring, or in the roof panels, or in other components of the furnace, as required.

The present invention has been described with reference to a DC arc furnace. The principles are however applicable to other types of furnaces. In particular the principles of the present invention may be used to reduce the incidence of stray arcing in a single- or multi-phase AC furnace. In a furnace type which includes multiple electrodes complex control and monitoring techniques may be resorted to in order to maintain surfaces of the furnace, which are isolated from each other, at desired voltages which are related to the operating conditions pertaining inside the furnace.

What is claimed is:

1. An arc furnace which includes a shell with a hearth, a roof for the shell, the roof including a plurality of segments which are substantially electrically isolated from each other and from the shell, an electrode and a refractory section on the roof, and means for establishing a voltage gradient at least across the refractory section and the hearth, and wherein the refractory section is at least partly electrically conductive.

2. A furnace according to claim 1, wherein the means for establishing the voltage gradient establishes a voltage difference between the refractory section and an adjacent component of the furnace selected from the hearth, electrode and a seal around the electrode of between 0% and 50% of a supply voltage which is applied to the furnace.

3. A furnace according to claim 1 wherein the means for establishing the voltage gradient includes a resistive voltage divider network.

4. A furnace according to claim 1 wherein the means for establishing the voltage gradient includes a plurality of switching devices which are responsive to operating conditions in the furnace.

5. A method of controlling the incidence of stray arcing in an arc furnace which includes a shell with a hearth, a roof for the shell, and a refractory section, which is at least partly electrically conductive, on the roof, the method including the step of establishing a voltage gradient at least between the refractory section and the hearth.

6. A furnace according to claim 5 wherein the voltage gradient establishes a voltage difference between the refractory section and an adjacent component of the furnace selected from the hearth, electrode and a seal around the electrode of between 0% and 50% of a supply voltage applied to the furnace.

7. A method according to claim 5 wherein the voltage gradient is fixed.

8. A method according to claim 5 wherein the voltage gradient is variable in response to selected operating conditions in the furnace.

9. A method according to claim 5 wherein the refractory section is made at least partly conductive by means of at least one conductive member which is at least partly exposed to the refractory section and current flow from the conductive member is monitored to detect erosion of the refractory section.

10. A method according to claim 5 which includes the step of providing a voltage, applied to the furnace, to a safe predetermined value when an arc is lost in the furnace.

* * * * *

UNITED STATES PATENT AND TRADEMARK OFFICE

CERTIFICATE OF CORRECTION

PATENT NO. : 6,246,712 B1
DATED : June 12, 2001
INVENTOR(S) : Rodney Murison Whyte et al.

It is certified that error appears in the above-identified patent and that said Letters Patent is hereby corrected as shown below:

Column 10,
Line 3, “furnace” should be -- method --.

Signed and Sealed this

Twenty-third Day of July, 2002

*Attest:*

*Attesting Officer*

JAMES E. ROGAN
*Director of the United States Patent and Trademark Office*